US006159117A

United States Patent [19]

Chan

[11] Patent Number: 6,159,117

[45] Date of Patent: Dec. 12, 2000

[54] STICKY DART

[75] Inventor: Cecil Shu On Chan, Hong Kong, The Hong Kong Special Administrative Region of the People's Republic of China

[73] Assignee: T.K. Wong & Associates Ltd., Hong Kong, The Hong Kong Special Administrative Region of the People's Republic of China

[21] Appl. No.: 09/448,656

[22] Filed: Nov. 24, 1999

[51] Int. Cl.[7] ..... A63B 65/02

[52] U.S. Cl. ..... 473/574; 446/34; 473/578

[58] Field of Search ..... 446/34; 473/574, 473/578, FOR 211, FOR 216

[56] References Cited

U.S. PATENT DOCUMENTS

| | | | |
|---|---|---|---|
| 735,415 | 8/1903 | Schrodel | 473/574 |
| 5,669,836 | 9/1997 | Hill | 473/574 |

*Primary Examiner*—John A. Ricci
*Attorney, Agent, or Firm*—Jackson Walker L.L.P.

[57] ABSTRACT

A sticky dart has a stem, and a nose with a layer of sticky material pivotably connected to a housing. When not in use, the nose is swivelled around so that the layer moves within the housing so as to prevent the layer becoming contaminated and unserviceable. A balance weight is readily movable and locatable along the stem to improve the aerodynamics of the dart when required.

8 Claims, 3 Drawing Sheets

STICKY DART

BACKGROUND OF THE INVENTION

1. Field of the Invention

The invention relates to sticky darts.

2. Description of Prior Art

Sticky darts are already known and often used in children's games. The darts are generally benign and each have stem with a sticky nose at one end and feathers or flights at the other end. Many suitable sticky materials are known, and include Styrene-Ethylene-Butylene-Styrene Co-polymer emulsified in mineral oil. The sticky material is normally suitable for adherence, even sometimes only for a limited time after impact, to surfaces made of cardboard, plastics, glass and metal.

However because the nose of the sticky dart adheres to most materials it is difficult to store. Even in normal use, the nose will collect dust and debris and become contaminated to the point of becoming inoperative. Also, as conventional sticky darts are inherently very light, their aerodynamic performance is unpredictable and cannot be easily varied.

SUMMARY OF THE INVENTION

It is an object of the invention to overcome or at least reduce one or more of these problems.

According to the invention there is provided a sticky dart having a stem with a first end and a second end, including a nose at the first end of the stem, a layer of sticky material on a forward part of the nose and a housing surrounding the nose, with the layer of sticky material positioned beyond a remote open end of the housing in a first operable position, in which the nose is arranged to be movable with respect to the housing so that the layer of sticky material is positioned wholly within the housing in a second operable position.

The nose may be pivotably mounted to the housing and rotatable between the first and second operable positions.

The nose may be slidably mounted to the housing for sliding between the first and second operable positions. The nose may also be rotatably mounted in the housing and includes locking means that operates when the nose is in a predetermined rotational position relative to the housing to interlock with the nose and prevent the nose sliding in the housing between the first and second operable positions.

Preferably, a balance weight is provided on the stem adjacent said first end. The balance weight may be integrally formed with the housing.

The balance weight may be movable and locatable along the length of the stem.

The dart may have integrally formed flights mounted at the other end of the stem.

BRIEF DESCRIPTION OF THE DRAWINGS

Sticky darts according to the invention will now be described by way of example with reference to the accompanying drawings in which.

DESCRIPTION OF THE PREFERRED EMBODIMENT

Figure 1:
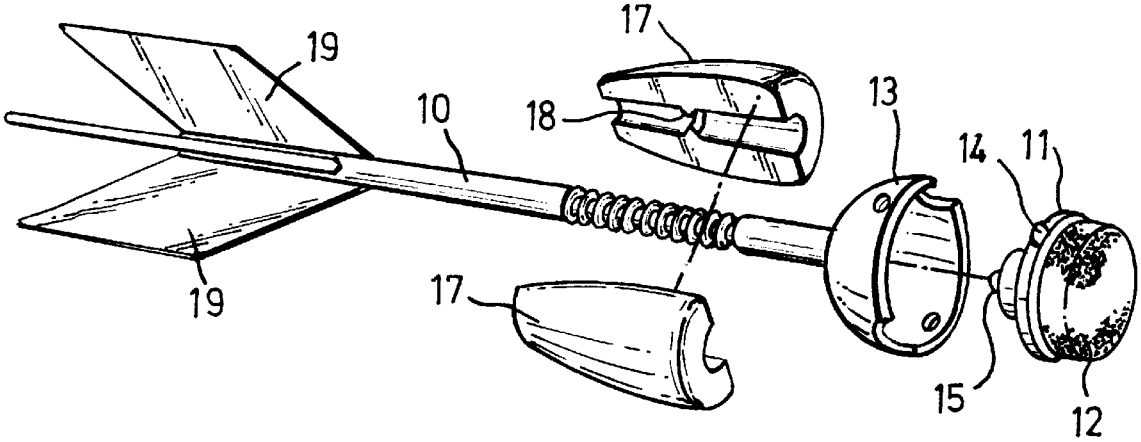
FIG. 1 is an exploded (or pre-assembly) isometric view of first sticky dart.
Figure 3:
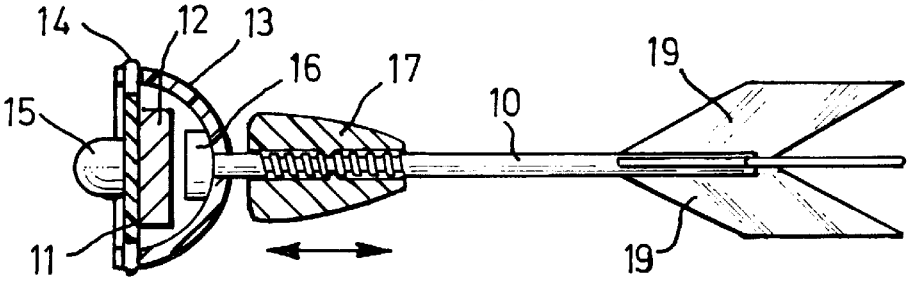
FIG. 3 is a part-section side view of the first dart in a second operable position.

Referring to the drawings, in FIGS. 1 and 3 the sticky dart has a threaded stem 10 and a nose 11 at a first end. A layer 12 of sticky material is mounted to a forward end of the nose and an open-ended housing 13 surrounds the nose 11. The nose 11 is pivotably attached to the housing 13 by opposing integrally formed stub axles 14.

Figure 2:
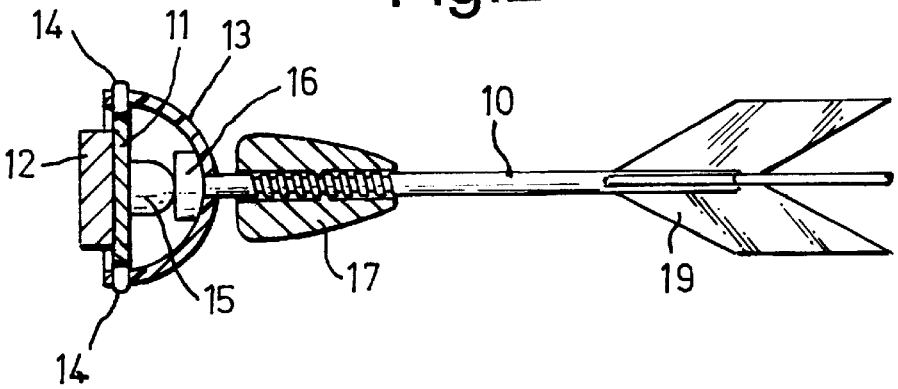
FIG. 2 is a sectional side view of the first sticky dart in a first operable position.

A rear end of the nose is provided with a small compressible nipple 15 that can be located against a base member 16 (see FIGS. 2 and 3) inside the housing 13. The nipple releasably holds the nose in the first operable position, as shown in FIG. 2. The second operable position is shown in FIG. 3 and it will be appreciated that the nose 11 is moved by relative rotation from the first to the second operable position. Thus, the layer 12 can be moved from the position in FIG. 2, where the layer 12 extends beyond a remote end of the housing and where the layer 12 is prone to collecting dust, being damaged or otherwise contaminated, to the position in FIG. 3. In FIG. 3, the layer 12 is wholly surrounded by the housing 13, which prevents the layer 12 becoming contaminated and also facilitates handling during non-active use and for storage.

A balancing weight 17, formed in two halves that fix together, is mounted on the stem 10. The weight 17 has a central channel with a simple thread or follower 18 so that when the stem 10 is rotated with respect to the weight 17, the weight is caused to move along the stem. This enables the balance weight to be moved and positioned on the stem where desired to improve the aerodynamics of the sticky dart.

The stem and the other parts are normally made of molded plastics material and flights 19 at the other end of the sticky dart are preferably integrally formed.

Figure 4:
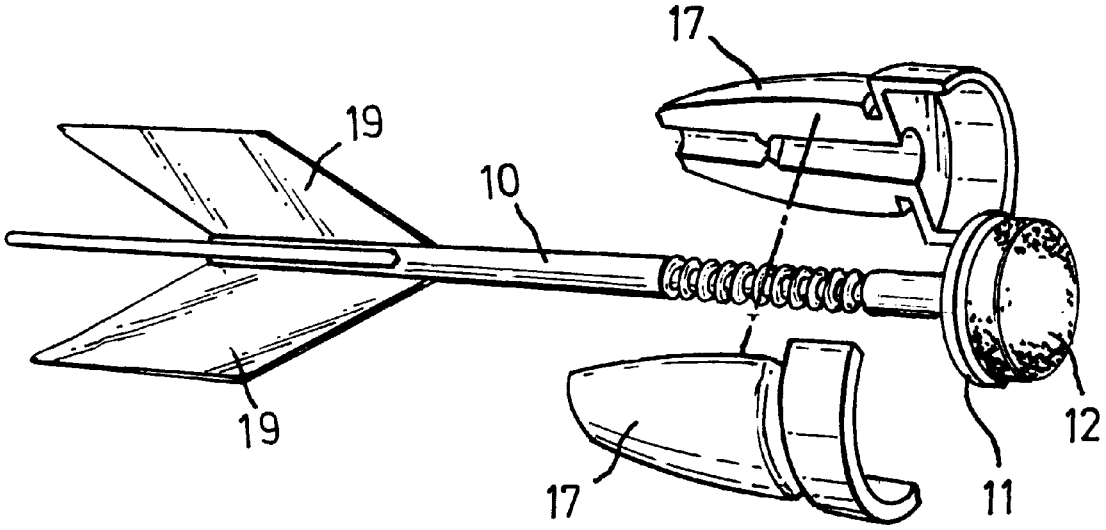
FIG. 4 is an exploded isometric view of a second sticky dart.
Figure 5:
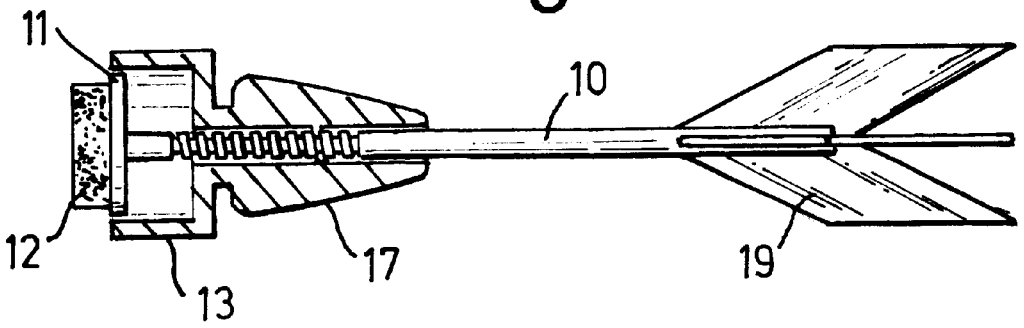
FIG. 5 is a sectional side view of the second sticky dart in a first operable position.
Figure 6:
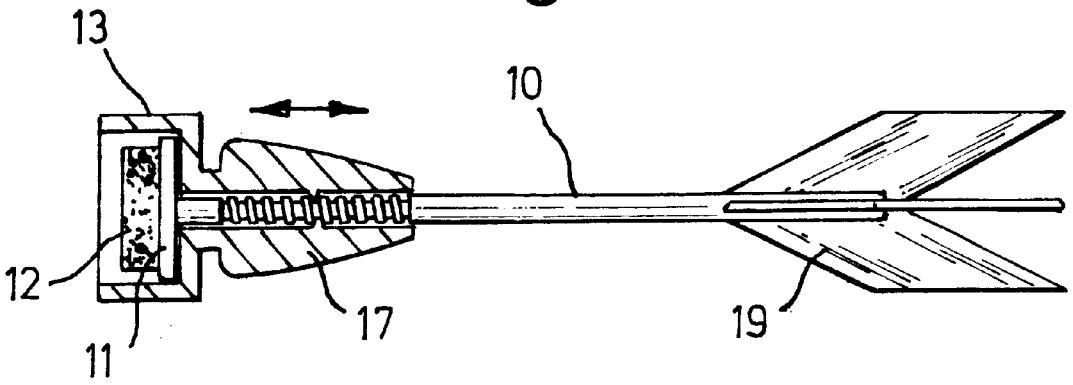
FIG. 6 is a sectional side view of the second sticky dart in a second operable position.

In FIGS. 4 to 6, a second sticky dart is shown in which like-parts have the same numerals as in FIGS. 1 to 3. It will be clear from the FIGS. 4 to 6 that in order to change the dart from the first operating position to the second operating position (and vice versa), the stem 10 must be rotated relative to the weight 17. In this second sticky dart the weight 17 and the housing 13 are integrally formed. In the second operating position (FIG. 3), the layer 12 has been withdrawn within the housing 13 and although the layer 12 is still exposed to dust which may enter into the housing 13, the dart is readily more easy to store and the layer 12 is not prone to inadvertent touching or the picking up of debris and the like.

It will be appreciated that the weight 17 may be slidable along the stem 10 and held in the required positions by suitable dimples or grooves or even by frictional resistance, say.

Figure 7:
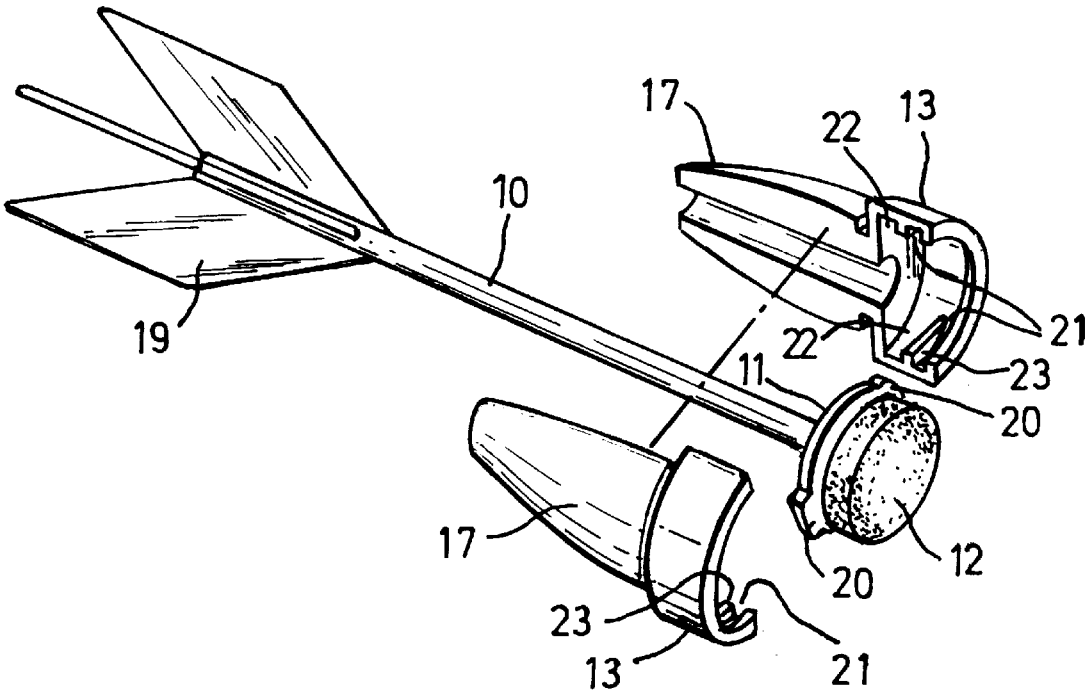
FIG. 7 is an exploded isometric view of a third sticky dart.
Figure 8:
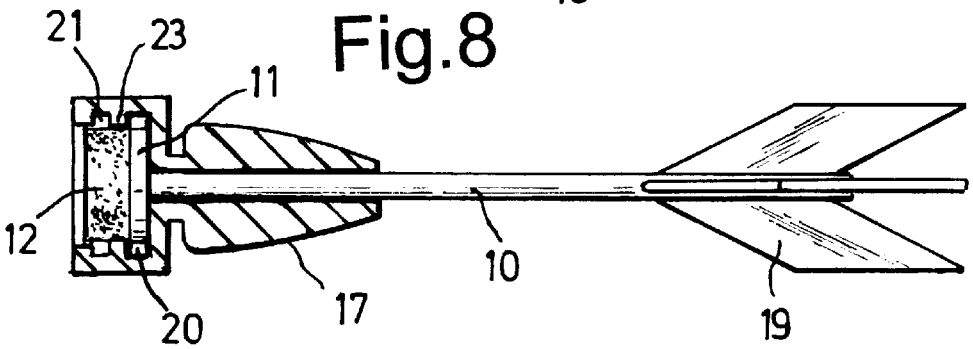
FIG. 8 is a sectional side view of the third sticky dart in a first operable position.
Figure 9:
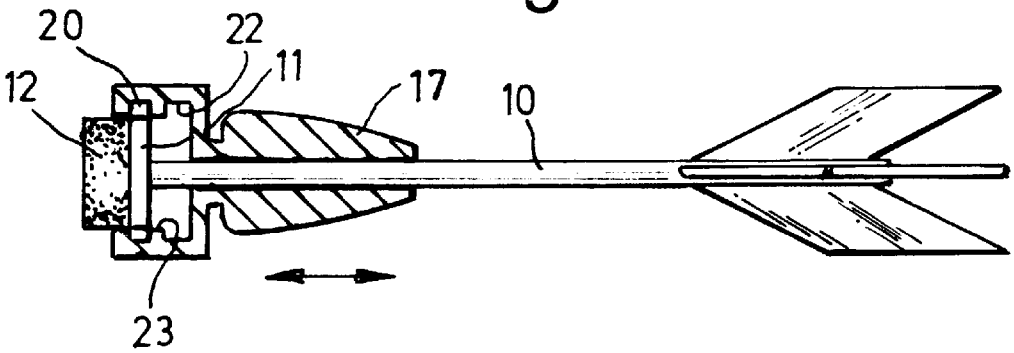
FIG. 9 is a sectional side view of the third sticky dart in a second operable position.

In FIGS. 7 to 9, the third sticky dart is generally the same as the second sticky dart, although it is possible to make the housing 13 and the balancing weight as separate parts. This allows the weight 17 to move along the stem 10 independently of the housing 13 if desired. The housing 11 has integrally formed opposing wings 20 that can fit into one of two grooves 21 and 22 formed on the inside surface of the housing 13. A channel 23 that separates the two grooves is noncontinuous allowing the wings to pass from one of the grooves to the other. Thus, in the position shown in FIG. 7, the nose 11 can be slid forwards and backwards to allow the layer 12 to be withdrawn into the housing, say, when the dart is moved from its first operating position (FIG. 8) to its second operating position (FIG. 9). In FIGS. 8 and 9, the nose 11 has been turned 90° from the position shown in FIG. 7 so that the nose 11 is locked in position. That is to say, the nose 11 cannot move forwards or backwards within the housing 13 unless the nose is first turned to the relative position shown in FIG. 7. Thus the wings 20 and grooves 21 and 22 provide a locking means for retaining the nose in its two operative positions.

As before, the layer 12 can be withdrawn to substantially reduce any contamination when the dart is not in active use.

The balancing weights 17 may be in the form of a figurine or other decorative or otherwise aesthetic form, and display a company logo or trademark, for example.

I claim:

1. A sticky dart having a stem with a first end and a second end, including a nose at the first end of the stem, a layer of sticky material on a forward part of the nose and a housing surrounding the nose, with the layer of sticky material positioned beyond a remote open end of the housing in a first operable position, in which the nose is arranged to be movable with respect to the housing so that the layer of sticky material is positioned wholly within the housing in a second operable position.

2. A sticky dart according to claim 1, in which the nose is pivotably mounted to the housing and rotatable between the first and second operable positions.

3. A sticky dart according to claim 1, in which the nose is slidably mounted to the housing for sliding between the first and second operable positions.

4. A sticky dart according to claim 3, in which the nose is rotatably mounted in the housing and includes locking means that operates when the nose is in a predetermined rotational position relative to the housing to interlock with the nose and prevent the nose sliding in the housing between the first and second operable positions.

5. A sticky dart according to claim 1, including a balance weight on the stem adjacent said first end.

6. A sticky dart according to claim 5, in which the balance weight is integrally formed with the housing.

7. A sticky dart according to claim 5, in which the balance weight is movable and locatable along the length of the stem.

8. A sticky dart according to claim 1, having integrally formed flights mounted at the other end of the stem.

* * * * *